US007775856B2

(12) United States Patent
Bhatnagar et al.

(10) Patent No.: US 7,775,856 B2
(45) Date of Patent: Aug. 17, 2010

(54) METHOD FOR REMOVAL OF SURFACE FILMS FROM RECLAIM SUBSTRATES

(75) Inventors: Yashraj K. Bhatnagar, Santa Clara, CA (US); Ronald R. Rayandayan, Union City, CA (US); Krishna Vepa, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/863,050

(22) Filed: Sep. 27, 2007

(65) Prior Publication Data

US 2009/0088049 A1 Apr. 2, 2009

(51) Int. Cl.
*B24B 1/00* (2006.01)

(52) U.S. Cl. ..... 451/38; 451/57; 451/63

(58) Field of Classification Search ..... 451/37, 451/38, 39, 40, 41, 57, 60, 63, 332, 333
See application file for complete search history.

(56) References Cited

U.S. PATENT DOCUMENTS

| | | | | |
|---|---|---|---|---|
| 4,494,303 | A | 1/1985 | Celler et al. | |
| 5,695,572 | A | 12/1997 | Brunner et al. | |
| 5,849,099 | A * | 12/1998 | McGuire | 134/10 |
| 5,981,301 | A * | 11/1999 | Muramatsu et al. | 438/4 |
| 6,287,173 | B1 | 9/2001 | Crevasse et al. | |
| 6,406,923 | B1 * | 6/2002 | Inoue et al. | 438/4 |
| 6,458,712 | B2 * | 10/2002 | Kramer et al. | 438/749 |
| 6,685,542 | B2 * | 2/2004 | Mori et al. | 451/65 |
| 6,849,548 | B2 | 2/2005 | Cooper et al. | |
| 7,100,826 | B1 * | 9/2006 | Phan et al. | 235/385 |
| 7,261,617 | B1 * | 8/2007 | Kim et al. | 451/38 |
| 7,337,076 | B2 | 2/2008 | Steele et al. | |
| 2002/0058418 | A1 * | 5/2002 | Lewis | 438/689 |
| 2002/0081954 | A1 * | 6/2002 | Mori et al. | 451/65 |
| 2004/0130691 | A1 | 7/2004 | Boonman et al. | |
| 2006/0169900 | A1 | 8/2006 | Noji et al. | |
| 2006/0211218 | A1 | 9/2006 | Boyle et al. | |
| 2007/0020784 | A1 | 1/2007 | Timans | |
| 2007/0203041 | A1 | 8/2007 | Lee | |
| 2007/0228524 | A1 | 10/2007 | Hayashida et al. | |
| 2007/0277861 | A1 | 12/2007 | Hiroe et al. | |

OTHER PUBLICATIONS

Yashraj K. Bhatnagar et al., US Patent Application entitled "Apparatus for Improving Incoming and Outgoing Wafer Inspection Productivity in a Wafer Reclaim Factory" U.S. Appl. No. 11/823,061, filed Jun. 25, 2007.

* cited by examiner

*Primary Examiner*—Timothy V Eley
(74) *Attorney, Agent, or Firm*—Blakely Sokoloff Taylor & Zafman LLP

(57) ABSTRACT

Embodiments of the invention describe a method for reclaiming a substrate by removing surface films with media blasting. A substrate is provided having a surface film. Media blasting is performed on the substrate to remove the surface film from the surface. In one embodiment media blasting removes a film from the substrate top surface. In another embodiment media blasting removes a film from the substrate top surface and side surface.

13 Claims, 5 Drawing Sheets

METHOD FOR REMOVAL OF SURFACE FILMS FROM RECLAIM SUBSTRATES

BACKGROUND OF THE INVENTION

1. Field of the Invention

The present invention relates to the field of reclamation and reuse of semiconductor material substrates. More particularly this invention relates to an apparatus and method for removal of surface films on wafers at a reclaim factory.

2. Discussion of Related Art

The increasing process complexity and introduction of new materials to the field of integrated circuit (IC) fabrication has given rise to a greater number of processing steps; each of which must be tested for quality.

Test wafers including "dummy" or "control monitor" wafers are used to check the reliability of IC fabrication equipment. For example, dummy wafers are used to test new IC fabrication equipment prior to its implementation into the large-scale production process of ICs. A dummy wafer is cycled through the new equipment and the ICs formed on the dummy wafer are then examined to determine if they meet certain specified criteria indicating that the fabrication process was properly performed. Only then is the equipment implemented into the production of ICs. Thereafter, the dummy wafer may be discarded, or "recycled" by removing the deposited films and re-using the dummy wafer.

Once fabrication equipment is implemented into the production process, it must be periodically inspected by examining the fabricated ICs to ensure that it is functioning properly. Such quality assurance testing is typically performed on a daily basis, such as at the beginning of every working shift. During such testing, control monitor wafers are used in a trial process, such as film deposition, performed on the wafer. The control wafer is then examined to determine if it meets certain specified criteria indicating that the fabrication process was properly performed. Thereafter, the control wafer may be discarded (to protect intellectual property, for example), or "recycled" by removing the deposited films and re-using the control wafer.

All of this quality assurance testing requires the use of a large number of wafers and increases the total cost of IC fabrication. Customers will typically recycle their wafers using their own equipment. However, each recycle roughens the wafer surface and after a few such cycles the wafers must be re-polished to meet fab specifications for such wafers to be used in their tools. These wafers are typically sent to a wafer reclaim vendor who provides the essential expertise and service for stripping and re-polishing the wafers to the customer's specifications and returning them to the customer for a service charge.

The reclamation cycle forms a loop in which used wafers are sent to a reclaim vendor, processed to meet fab specification, and sent back to the customer for reuse as test wafers. Customers optimize cost-cutting by reducing the number of test wafers to be used, and by using them as many times as possible. This requires maintaining a high ratio of reclaimed wafers to total test wafers. In order to meet customer demands, wafer reclaim factories must in turn optimize the wafer reclaim process and offer cycle times in the order of days rather than weeks.

A typical wafer reclamation process includes multiple preliminary steps of incoming wafer inspection, ID detection, and sorting of the wafers into groups. The grouped wafers are then subjected to removal steps such as grinding and/or etching particular materials, followed by polishing and cleaning. The process is finalized with a final multi-step outgoing wafer inspection to ensure that the proper amount of material was removed, and that customer specifications such as those for surface particles and wafer flatness are met.

The presence of copper films in the back-end processes has posed new problems to the wafer reclaim industry. Particularly, copper bulk contamination during the stripping process is detrimental because rapid diffusion of copper in silicon at relatively low temperatures can cause the metal to form deep level traps for carriers. It is risky to employ traditional film-removal methods, such as grinding and etching techniques because both have shortcomings when it comes to removing copper.

Traditional etching techniques involve the immersion of wafers in a series of chemical baths to strip film materials and etch the wafer. The chemical solutions used to remove films from wafers typically contain hydrofluoric acid (HF). Hydrofluoric acid solutions etch oxidized silicon, which can cause severe pitting of the wafer surface. Furthermore, any metallic contamination, such as copper, present in the stripping solutions from etching of the films has a very high likelihood of contaminating the bulk silicon.

Traditional grinding techniques physically remove films by placing a wafer between two counter-rotating plates and lapping away material. While this technique effectively removes films from the front and back surfaces of wafers, it does not remove contamination on the wafer edge. Wet grinding with slurries poses additional issues of particle contamination on opposite surfaces. On the other hand dry grinding without slurries, while having the benefit of reduced cross-contamination compared to wet grinding, causes severe microcracking that can extend between 10 μm and 50 μm into the substrate. This 10 to 50 μm damaged layer has to then be removed in subsequent polishing steps to recover the original wafer finish. Consequently, this results in the possibility to reprocess the wafer only a few times.

Therefore, what is needed is a reasonable and cost-effective method for removing wafer surface and edge films that does not suffer the negative impacts associated with current etching and grinding techniques.

SUMMARY OF THE INVENTION

A method for removing surface films on substrates is disclosed. A substrate is provided having a surface film thereon. Media blasting is performed on the substrate to remove the surface film from the substrate. Utilizing embodiments of the invention films can be quickly removed from substrates while surface and sub-surface damage is minimized.

DETAILED DESCRIPTION OF THE PRESENT INVENTION

Figure 1A:
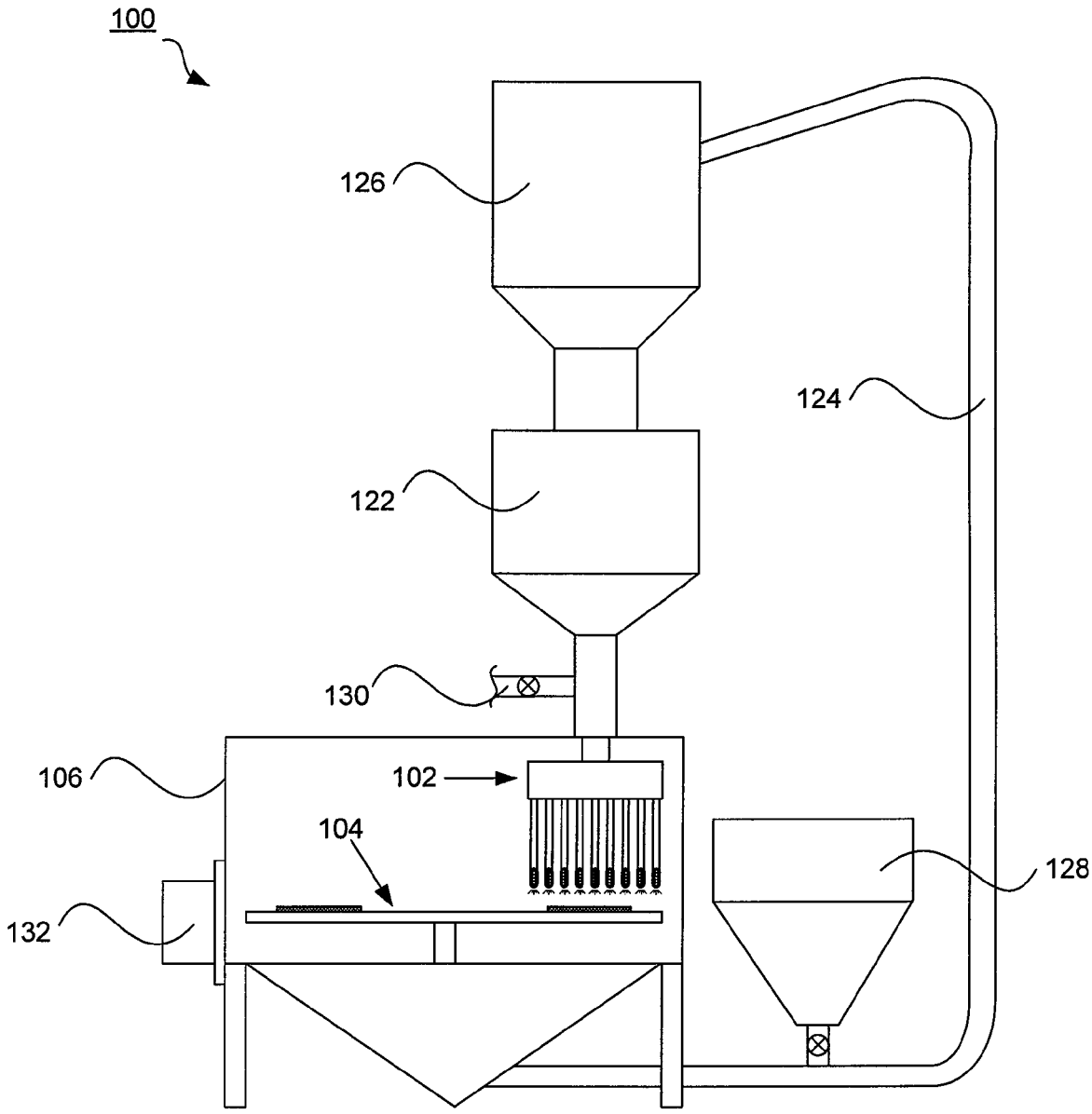
FIG. 1A illustrates a side view of an exemplary media blasting system that is employed by embodiments of the invention.

Embodiments of the present invention disclose a method for removal of surface films from a substrate. In various embodiments, an apparatus and method for removal of surface films is described with reference to figures. However, certain embodiments may be practiced without one or more of these specific details, or in combination with other known materials and configurations. In the following description, numerous specific details are set forth, such as specific configurations, dimensions and materials, etc., in order to provide a thorough understanding of the present invention. In other instances, well-known manufacturing techniques have not been described in particular detail in order to not unnecessarily obscure the present invention. Reference throughout this specification to "one embodiment" means that a particular feature, structure, configuration, or characteristic described in connection with the embodiment is included in at least one embodiment of the invention. Thus, the appearances of the phrase "in one embodiment" in various places throughout this specification are not necessarily referring to the same embodiment of the invention. Furthermore, the particular features, structures, configurations, or characteristics may be combined in any suitable manner in one or more embodiments.

Embodiments of the invention describe a substrate reclaim process in which surface films are removed from a substrate by media blasting. Embodiments of the invention are particularly useful for removing surface films from wafers at a wafer reclaim factory. In an embodiment the wafer is a reclaim grade silicon wafer. However, the wafer may be other grades of silicon such as prime grade or test grade. In another embodiment, the wafer is comprised of a III-V material such as GaAs or InP. The wafer can be composed of any semiconductor material in which there is a cost benefit for reclaiming.

As wafers enter the reclaim factory, wafers are subjected to preliminary steps of inspection and sorting. For example, incoming wafers are visually inspected and sorted into separate groups for Cu containing films, Al containing films, and oxide, nitride, and/or poly containing films in order to reduce cross-contamination between reclaimed wafers during processing. Multi-layer patterned wafers, and chipped or broken wafers are additionally sorted out from the reclaim process at this time. In one embodiment incoming wafer ID and thickness is measured in order to identify and sort out the wafers that would be expected to be too thin for reclaiming after the completion of all processing. In an alternative embodiment the refractive index and x-ray fluorescence of the wafer surfaces are measured in addition to measuring incoming wafer ID and thickness in order to identify known film compositions and further sort the wafers into processing groups. Then the wafers are stripped using a media blasting operation. In an embodiment the media material, media size, blasting pressures, blasting angles, and blasting time are tailored to the specific group (for example, Cu, Al, or oxide/nitride/poly) or thickness of films to be removed. The wafers are then visually inspected again to verify all films were removed from the wafers during the media blasting operation. The wafers are then polished, cleaned, inspected for surface quality and impurities and packaged according to customer specification. The reclaimed wafers are then shipped to the customer.

In one aspect, embodiments of the invention completely remove surface films from substrates, while minimizing surface and sub-surface damage. This is achieved by optimizing the media blasting processing conditions including selected media hardness and mesh size, and controlling media blasting pressures, angles, and time. In another aspect, embodiments of the invention minimize cross-contamination of wafers from copper and other contaminants contained in surface films removed during the reclaim process. This is achieved by the automatic removal of the blasting media and blasted/removed surface film material away from the processed surface while in the solid phase.

FIG. 1A is an illustration of an exemplary media blasting system that is employed by embodiments of the invention. The media blasting system can be a commercially available unit such as the Empire PF-6060-RS rotary head batch processing machine available from Empire Abrasive Equipment Company of Langhorne, Pa. As shown in FIG. 1A, media blasting system 100 contains a rotary head assembly 102 and turntable assembly 104 located within a processing cabinet 106. Turntable assembly 104 is connected to a pair of tracks (not shown) that allow turntable assembly 104 to slide in and out of processing cabinet 106 through door assembly 132 for loading and unloading.

Figure 1B:
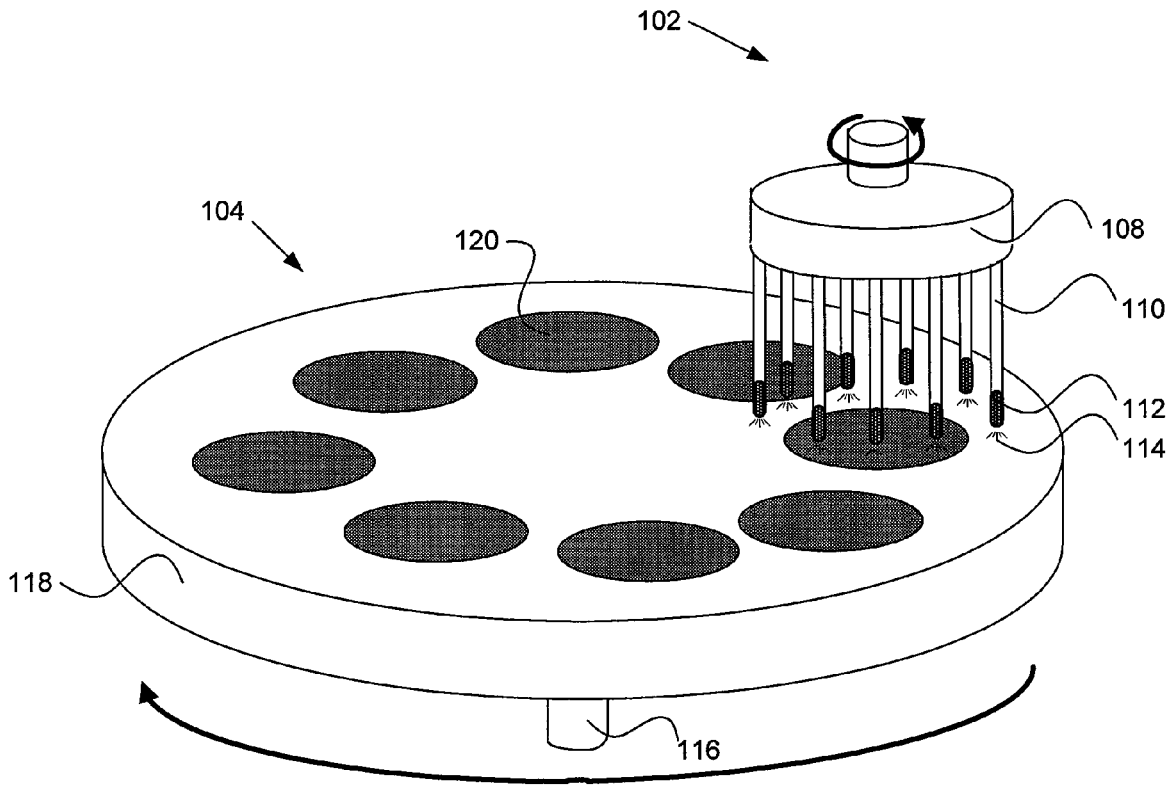
FIG. 1B illustrates a close-up side view of the rotary head assembly and turntable assembly of FIG. 1.

A close-up isometric view of the rotary head assembly 102 and turntable assembly 104 is provided in FIG. 1B. Turntable assembly 104 is comprised of an axle 116 supporting a turntable 118. Wafers 120 having a top surface, a bottom surface, and a side surface are positioned on the top surface of turntable 118. In an embodiment films are disposed on the top surfaces of wafers 120. In another embodiment films are disposed on the top and side surfaces of wafers 120.

Figure 1C:
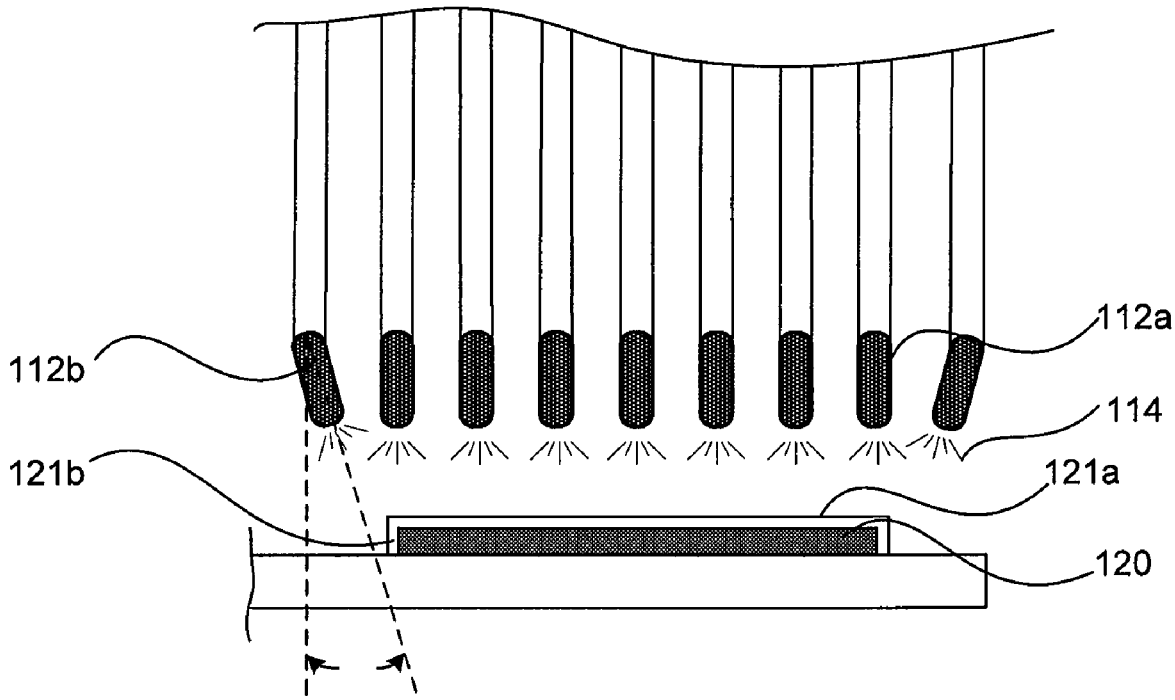
FIG. 1C illustrates a side view of an embodiment where surface films are blasted from the top surface and side surface of a wafer.

Rotary head assembly 102 is comprised of a rotary head unit 108 to which multiple nozzles 112 are connected by adjustable tubing 110. In an embodiment, adjustable tubing 110 is configured so that nozzles 112 are positioned perpendicular to wafers 120. In another embodiment, as shown in FIG. 1C, tubing 110 is adjusted so that at least some nozzles 112*b* are positioned at an angle ($\alpha$) to the top surface of wafers 120 while the remaining nozzles 112*a* are positioned perpendicular to the top surface wafers 120. In such an embodiment, nozzles 112*b* may be positioned at an angle ($\alpha$) to the top surface of wafers 120 in order to more effectively remove films 121*b* from the edges of wafers 120 in addition to the films 121*a* on the top surfaces of wafers 120. Nozzles 112 are composed of a hard material such as tungsten carbide (WC) in order to provide reduced wear and an increased lifetime. Nozzles 112 should be composed of a material with hardness greater than that of the media being blasted. In an embodiment rotary head assembly 102 rotates in a direction opposite to a direction that turntable assembly 104 rotates so that wafers 120 are subjected to a uniform blasting gradient from the multiple nozzles 112. In an embodiment rotary head assembly 102 rotates counter-clockwise, and turntable assembly 104 rotates clockwise.

Again referring to FIG. 1A, the media are stored in media storage hopper 122. Media can be any suitable material for blasting, such as but not limited to silicon carbide (SiC), white or brown alumina (Al2O3), zirconia (ZrO2), plastic media, or glass media. In a specific embodiment tailored for removal of copper films, media is selected to possess a Moh's Hardness greater than the Moh's Hardness for copper (approximately 3.0). In another embodiment, media is selected to possess a Moh's Hardness less than the hardness for a silicon substrate (approximately 6.5) in order to preserve the silicon substrate surface smoothness and to additionally not remove more substrate material than necessary. In yet another embodiment, media is selected to possess a Moh's hardness greater than that of a silicon substrate. In such an embodiment, some amount of the silicon substrate can be expected to be removed during blasting in order to ensure complete removal of the overlying films. In operation, a predetermined flow rate of media is flowed from media storage hopper 122 to the rotary head assembly 102, and exits as a blast spray 114 characterized by its blast pressure.

The used media and contaminants removed from the wafers 120 are collected at the bottom portion of cabinet 106 and removed through a process line 124. Process line 124 transfers the used media and contaminants to reclaimer assembly 126. Reclaimer assembly 126 may consist of a cyclone centrifuge, a magnetic separator for removing metal contaminants, and multiple vibrating sieves. Reclaimer assembly 126 separates the reusable blast media from the non-reusable blast media and contamination removed from wafers 120. In an embodiment, the vibrating sieves of reclaimer assembly 126 filter out particles/media below 180 mesh and pass through reusable media that is above 180 mesh. The reusable blast media is then fed back into media storage hopper 122. It is to be appreciated that media blasting system 100 can vary in terms of layout and components, and the apparatus 100 described herein is meant to be exemplary and not limiting. For example, an optional make-up hopper 128 can be positioned on process line 124 to compensate for media that can not be reused. In another embodiment an injection line 130 can be positioned between media storage hopper 122 and cabinet 106 in order to inject a liquid into the system so that nozzles 112 emit a wet media blast spray 114. In such an embodiment, utilizing a wet media blast spray 114 functions to minimize surface and sub-surface damage of wafers 120.

Figure 2:
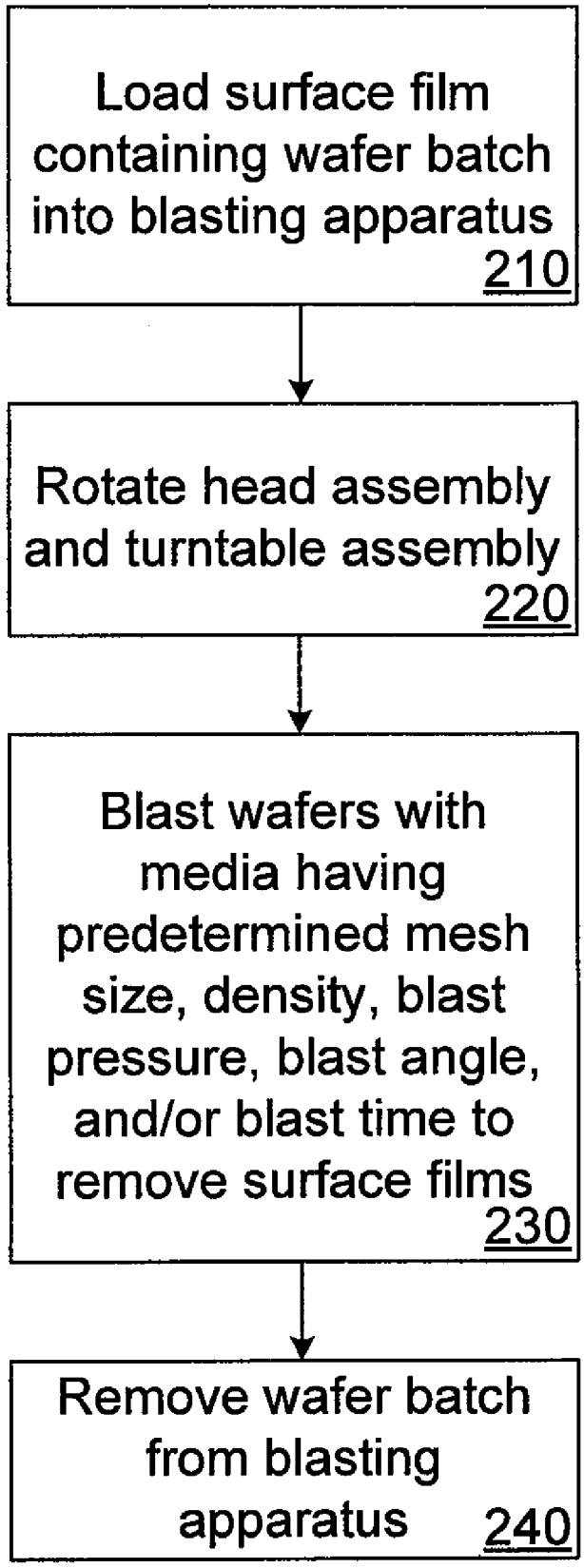
FIG. 2 illustrates an embodiment of a method for removing a surface film from a wafer.

FIG. 2 illustrates an embodiment of a method for removing a surface film from a wafer. As set forth in block 210 a batch of wafers 120 containing surface films is loaded into the blasting apparatus 100. In one embodiment approximately 8 to 10 wafers are processed in one batch cycle. In one embodiment wafers 120 are secured to the turntable 118 by means of a vacuum. Wafers 120 are mounted onto the turntable 118 with the top sides containing film(s) 121*a* to be removed facing up. Films 121*b* may also be on the side surface or edges of wafers 120.

As set forth in block 220 the rotary head assembly 102 and turntable assembly 104 are rotated. Rotary head assembly 102 is rotated at a speed of 10 to 40 RPM, and more specifically approximately 30 RPM, while turntable assembly 104 is rotated in an opposite direction at a speed of 0.1 to 0.5 RPM, and more specifically approximately 0.3 RPM. In an embodiment rotary head assembly 102 rotates counter-clockwise, and turntable assembly 104 rotates clockwise.

The wafers 120 are then subjected to a blasting operation to remove surface films, as set forth in block 230. Blasting media is fed from media storage hopper 122 to the rotary head assembly 102 and exits nozzles 112 as a blast spray 114 which physically removes the surface films from the wafers. In one embodiment blast spray 114 blasts dry media. In an alternative embodiment, a liquid is fed into the system through injection line 130 to create a wet media blast spray 114.

Wafers 120 are subjected to a substantially uniform blasting gradient from the multiple nozzles 112 as the turntable 118 moves wafers 120 underneath the rotary head assembly 102 one at a time. Surface films 121*a* are substantially removed from the top surface wafers 120 while surface and sub-surface damage of the underlying substrate is minimized. In one such embodiment, the media is selected to possess a Moh's hardness less than that of the substrate in order to preserve the substrate surface smoothness and to additionally not remove more substrate material than necessary. In another embodiment, blast spray 114 removes a film 121*a* from the top surface of wafer 120 as well as a portion of the top surface of a wafer 120. In one such embodiment, the media is selected to possess a Moh's hardness greater than that of the substrate.

In another embodiment, side films 121*b* are substantially removed from wafers 120 at the same time surface films 121*a* are removed. In one such embodiment, at least some of the nozzles 112*b* are positioned at an angle ($\alpha$) to the top surface of the wafers 120 while the remaining nozzles 112*a* are positioned perpendicular to the top surface of wafers 120. In yet another embodiment, blast spray 114 removes a film from the top and side surfaces of wafer 120 as well as a portion of the top surface and side surface of wafer 120.

The media material, media size, blasting pressures, blasting angles, and blasting time may be specifically tailored to the specific groups and/or thicknesses of film compositions to be removed from specific substrates during the blasting operation. In an experimental method according to an embodiment of the present invention, oxide films approximately 3000 angstroms thick were grown on the top surfaces of a batch of 8 silicon wafers, and then copper films approximately 3 microns thick were deposited on the oxide films and patterned. The batch of wafers was then subjected to a blasting operation with nozzles being positioned perpendicular to and approximately 5 to 6 inches above the wafer top surfaces. Blast media was a white alumina, brown alumina, or silicon carbide with a commercially designated mesh size of plus 180 mesh. Blasting pressures ranged from 15 to 30 psi, and blasting time ranged from 4 to 12 minutes, more specifically 8 to 10 minutes. These processing conditions were found to be useful in completely removing the copper and oxide film stack from the top surfaces of the silicon wafers.

The blasting operation time for embodiments of the invention is considerably faster than conventional etching techniques, as well as for many grinding techniques. Surface and sub-surface damage such as microcracking is much less than is capable with some dry grinding techniques. Additionally, issues of cross-contamination that are inherent in wet processes such as etching and wet grinding techniques can be avoided with the dry blasting technique. Upon completion of the blasting operation, the batch of wafers is then removed from cabinet 106 through the sliding door assembly 132, as set forth in block 240.

Figure 3:
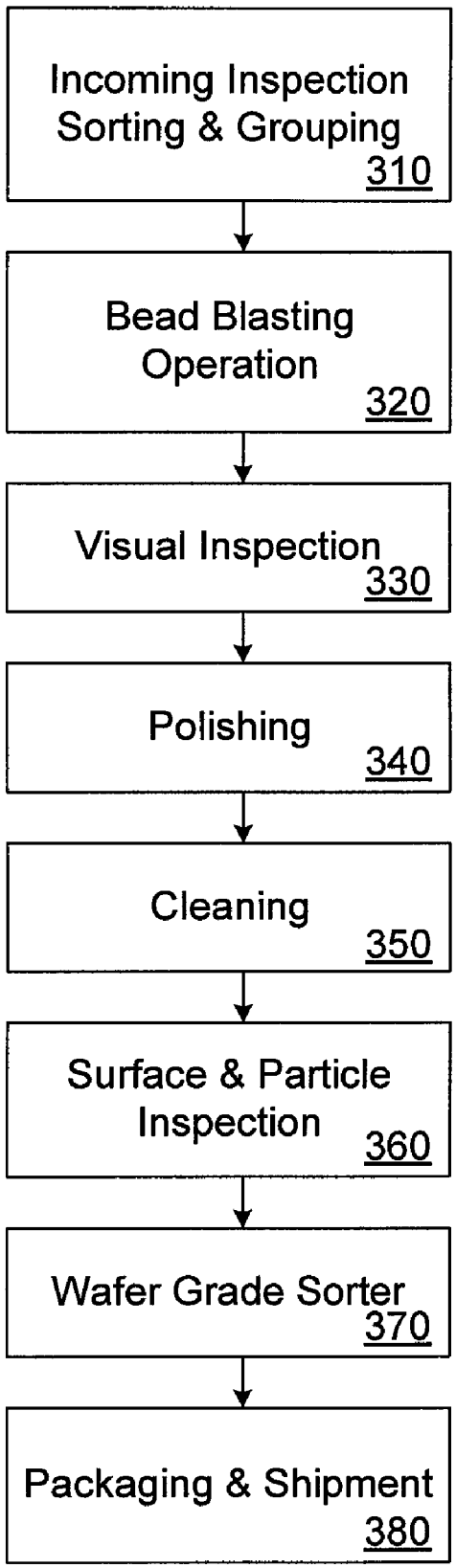
FIG. 3 illustrates an embodiment of a method for reclaiming a wafer.

FIG. 3 illustrates an embodiment of a method for reclaiming a wafer. As set forth in block 310 incoming wafers are inspected, sorted, and grouped. In one embodiment, incoming wafers are visually inspected and sorted into separate groups for copper containing films and non-copper containing films. In another embodiment, incoming wafers are visually inspected and sorted into copper containing films, aluminum containing films, and oxide, nitride, and/or poly containing films in order to reduce cross-contamination between reclaimed wafers during processing. Multi-layer patterned wafers, and chipped or broken wafers are additionally sorted out from the reclaim process at this time. In one embodiment incoming wafer ID and thickness is measured in order to identify and sort out the wafers that would be expected to be too thin for reclaiming after the completion of all processing. In one alternative embodiment the refractive index and x-ray fluorescence of the wafer surfaces are measured in addition to measuring incoming wafer ID and thickness in order to identify known film compositions and further sort the wafers into processing groups. In an alternative embodiment, incoming wafers are not sorted into groups based on composition.

After incoming inspection, sorting, and grouping the wafers are subjected to a bead blasting operation, as set forth in block 320. As described above for FIG. 2, the media material, media size, blasting pressures, blasting angles, and blasting time can be specifically tailored for the blasting operation. In one embodiment the batch of wafers being blasted is comprised of a single group of wafers which have been grouped based on composition. For example, a single batch is comprised entirely of a group of wafers with copper containing films. Alternatively a single batch is comprised entirely of a group of wafers having a similar film thickness to be removed.

In another embodiment, a single batch is comprised of wafers from different composition or film thickness groups. Alternatively a single batch of wafers has not been grouped. In such embodiments, dry media blasting inherently minimizes cross-contamination of wafers from, for example, copper and other contaminants contained in the films because the media and blasted/removed contaminants are automatically removed from the processed surface of the wafers while in the solid phase.

Upon completion of the blasting operation, the wafers are visually inspected, as set forth in block 330, to verify that all films were removed during the media blasting operation. The wafers are then polished to customer specifications (FIG. 3, block 340). Polishing may be double-side polishing (DSP) or single-side polishing (SSP) depending on customer specifications. The polished wafers are then thoroughly cleaned (FIG. 3, block 350) inspected for surface quality and impurities (block 360), sorted (block 370), and packaged according to customer specification and shipped (block 380).

Although the present invention has been described in language specific to structural features and/or methodological acts, it is to be understood that the invention defined in the appended claims is not necessarily limited to the specific features or acts described. The specific features and acts disclosed are instead to be understood as particularly graceful implementations of the claimed invention useful for illustrating the present invention.

What is claimed is:

1. A method of removing surface films from a substrate comprising:

performing an analytical measurement to determine surface film compositions of a multiplicity of incoming substrates;

after performing the analytical measurement, sorting the multiplicity of incoming substrates into groups, wherein the groups comprise a copper containing film group and a non-copper containing film group;

providing a substrate from the copper containing film group onto a turntable, the substrate having a top surface, a bottom surface, and a side surface, wherein a copper containing film is disposed on the top surface;

blasting the substrate with media until the copper containing film is substantially removed from the top surface.

2. The method of claim 1, wherein blasting is performed at a pressure between 15 and 30 psi.

3. The method of claim 1, wherein blasting is performed for a time period from 4 to 12 minutes.

4. The method of claim 1, further comprising blasting the substrate with media until a side film is substantially removed from the side surface.

5. The method of claim 1, wherein the media is plus 180 mesh.

6. The method of claim 1, wherein the media has a Moh's Hardness greater than the Moh's hardness of the copper containing film and less than the Moh's hardness of the substrate.

7. The method of claim 1, wherein the media has a Moh's Hardness greater than the Moh's hardness of the copper containing film and substrate.

8. The method of claim 7, further comprising blasting the substrate with media until a portion of the substrate is removed.

9. The method of claim 1, further comprising blasting the substrate with a wet media slurry.

10. A method for reclaiming a wafer comprising:

performing an analytical measurement to determine surface film compositions of a multiplicity of incoming wafers;

after performing the analytical measurement, sorting the multiplicity of incoming wafers into groups, wherein the groups comprise a copper containing film group and a non-copper containing film group, and wherein the wafers have a top surface, bottom surface, and side surface;

placing a wafer from the copper containing group onto a turntable with the wafer top surface facing up;

blasting the wafer top surface with a media having a Moh's hardness greater than 3 until the copper containing film is substantially removed from the wafer top surface.

11. The method of claim 10, wherein the media is plus 180 mesh.

12. The method of claim 10, wherein sorting the wafers into groups further comprises an aluminum containing group.

13. The method of claim 10, further comprising visually inspecting the wafer to verify the copper containing film is removed, polishing the wafer, and cleaning the wafer.

* * * * *